US010047297B2

(12) United States Patent
Koch et al.

(10) Patent No.: US 10,047,297 B2
(45) Date of Patent: Aug. 14, 2018

(54) DEVICE AND METHOD FOR EXTRACTING CARBON-CONTAINING SUBSTANCES FROM OIL SAND

(71) Applicant: SIEMENS AKTIENGESELLSCHAFT, München (DE)

(72) Inventors: Andreas Koch, Neunkirchen am Brand (DE); Bernd Leidinger, Dresden (DE); Hermann May, Veitsbronn (DE); Matthias Schöneich, Görlitz (DE)

(73) Assignee: Siemens Aktiengesellschaft, München (DE)

( * ) Notice: Subject to any disclaimer, the term of this patent is extended or adjusted under 35 U.S.C. 154(b) by 805 days.

(21) Appl. No.: 14/417,150

(22) PCT Filed: Jun. 20, 2013

(86) PCT No.: PCT/EP2013/062857
§ 371 (c)(1),
(2) Date: Jun. 15, 2015

(87) PCT Pub. No.: WO2014/016062
PCT Pub. Date: Jan. 30, 2014

(65) Prior Publication Data

US 2015/0275096 A1 Oct. 1, 2015

(30) Foreign Application Priority Data

Jul. 24, 2012 (DE) ..... 10 2012 014 658

(51) Int. Cl.
*C10G 1/04* (2006.01)
*E21B 43/24* (2006.01)
(Continued)

(52) U.S. Cl.
CPC ..... *C10G 1/047* (2013.01); *C10G 1/002* (2013.01); *E21B 43/24* (2013.01); *F28D 7/00* (2013.01)

(58) Field of Classification Search
CPC ..... C10G 1/047; C10G 1/002; F28D 7/00; E21B 43/24
See application file for complete search history.

(56) References Cited

U.S. PATENT DOCUMENTS 4,007,786 A 2/1977 Schlinger
6,988,549 B1 * 1/2006 Babcock ..... E21B 43/2406 166/267
(Continued)

FOREIGN PATENT DOCUMENTS

DE 102007008292 A1 8/2008
DE 102007040605 B3 10/2008
(Continued)

OTHER PUBLICATIONS

Russian National Grant Receipt for related Russian Application No. 2015105777/03, dated Mar. 27, 2017, with English Translation.
(Continued)

*Primary Examiner* — Prem C Singh
*Assistant Examiner* — Juan C Valencia
(74) *Attorney, Agent, or Firm* — Lempia Summerfield Katz LLC

(57) ABSTRACT

The invention relates to a device for extracting carbon-containing substances, in particular bitumen, from oil sands. The device comprises two separate steam circuits. The first steam circuit is a closed steam circuit, in which a steam turbine (3) is operating. The second steam circuit is an open steam circuit and is used for extracting carbon-containing substances, in particular bitumen, from oil sands. The steam turbine (3) comprises an intermediate steam removal facility
(Continued)

(4), wherein the intermediate steam is used to evaporate the water/vapor in the second steam circuit via a heat exchanger. The invention further relates to a method for extracting carbon-containing substances by means of the previously described device.

5 Claims, 1 Drawing Sheet

(51) Int. Cl.
*C10G 1/00* (2006.01)
*F28D 7/00* (2006.01)

(56) References Cited

U.S. PATENT DOCUMENTS

2010/0258315 A1 10/2010 Lockhart
2011/0042063 A1 2/2011 Diehl et al.
2011/0042085 A1 2/2011 Diehl et al.
2011/0227349 A1 9/2011 Huber et al.
2013/0105151 A1* 5/2013 Rop ..... E21B 43/24 166/263

FOREIGN PATENT DOCUMENTS

DE 102008047219 A1 3/2010
DE 102012000092 A1 8/2013
RU 2060378 C1 5/1996
RU 2173825 C1 9/2001

OTHER PUBLICATIONS

German Office Action for German Application No. 10 2012 014 658.2, dated Apr. 22, 2013 with English Translation.
PCT International Search Report and Written Opinion of the International Searching Authority dated Jul. 18, 2014 for corresponding PCT/EP2013/062857.

* cited by examiner

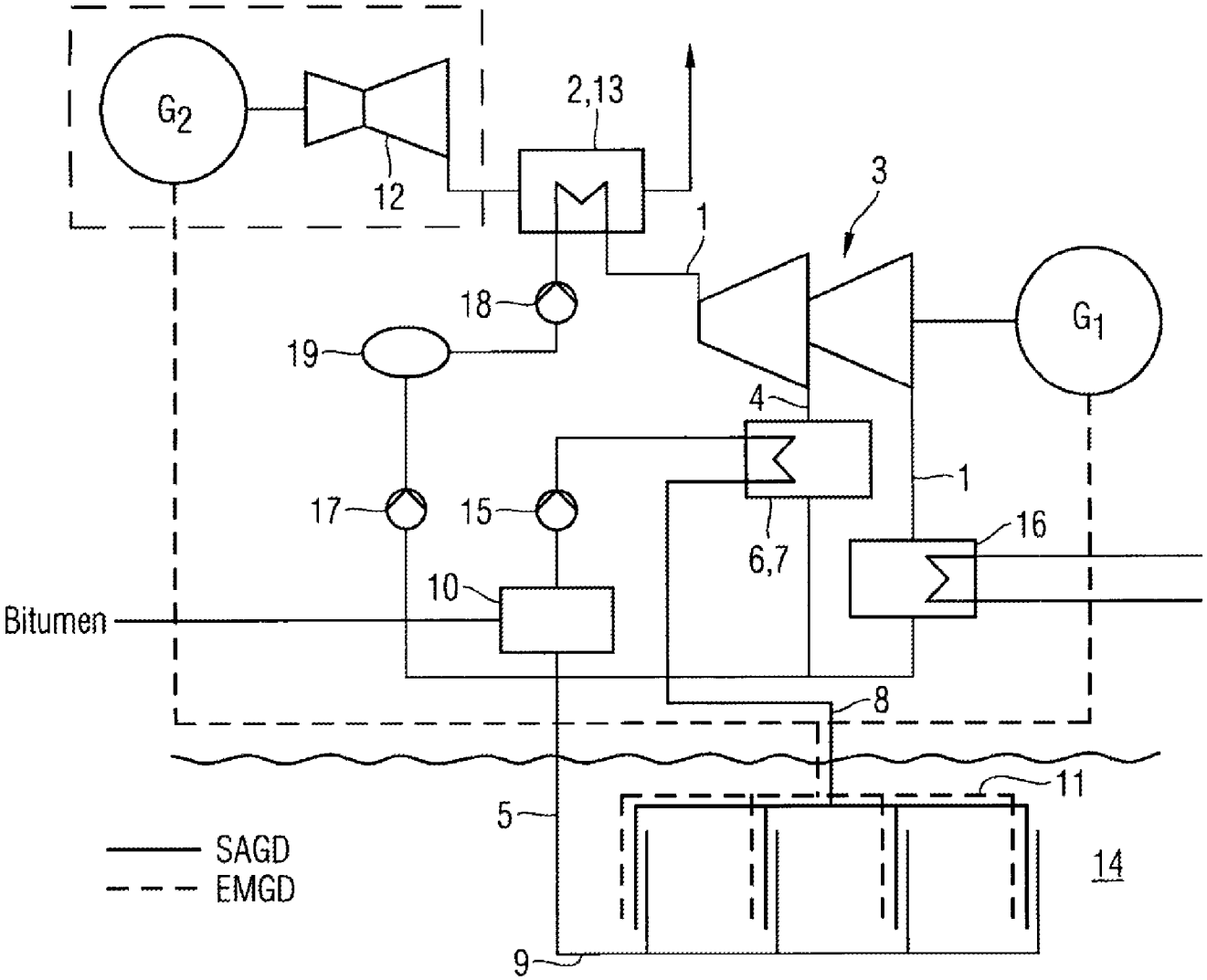
G1
G2
1
1
2,13
3
4
5
6,7
8
9
10
11
12
14
15
16
17
18
19
Bitumen
SAGD
EMGD

DEVICE AND METHOD FOR EXTRACTING CARBON-CONTAINING SUBSTANCES FROM OIL SAND

This application is the National Stage of International Application No. PCT/EP2013/062857, filed Jun. 20, 2013, which claims the benefit of German Patent Application No. 10 2012 014 658.2, filed Jul. 24, 2012. The entire contents of these documents are hereby incorporated herein by reference.

BACKGROUND

The present embodiments relate to extracting carbonaceous substances from oil sand.

Large portions of the worldwide oil reserves exist in the form of oil sand. A mixture of rock, clay, sand, water, and bitumen or other heavy oils is understood by oil sand. Only bitumen, which typically exists with a viscosity of API 5° to 15° with respect to deposits, is mentioned in the following text as being representative for heavy oils, extra-heavy oils, or generally long-chain hydrocarbons. By corresponding process acts, the bitumen may be converted into synthetic crude oil.

Oil sand deposits, if the oil sand deposits lie in strata of shallow depth, are mined by, for example, open-cast mining. Oil sand deposits, however, often lie in deeper strata that are not accessible to open-cast mining or the mining of which would be uneconomical in open-cast mining. Oil sand deposits are typically mined after depths of about 60 m by in-situ processes since with these processes the removal of the surface layer, which lies above the oil sand deposit, is not necessary.

The common in-situ process is the steam assisted gravity drainage (SAGD). With the SAGD process, the bitumen, which is present in the earth in a deposit, is heated by superheated steam. As a result of the heat effect, the long-chain hydrocarbons of the highly viscous bitumen are broken down. The heating of the oil sand leads to a reduction of the viscosity of the bitumen that, as a result, becomes free-flowing and may be pumped out of the deposit in a conventional manner.

The device for the SAGD process includes at least one injection pipeline for feeding the superheated steam into the deposit and a production pipeline through which the fluid bitumen may be transported out of the deposit to the earth's surface. The injection pipeline and the production pipeline are laid inside the deposit essentially parallel to each other and extending horizontally one above the other. The injection pipeline and the production pipeline may have a distance of about 5 m to 10 m from each other in the vertical direction. In the horizontal direction, the pipes extend inside the deposit by a length of between several hundred meters and a few kilometers. The injection pipeline may be located above the production pipeline. As a result of the heating of the bitumen and the reduction of the viscosity thereof, the bitumen flows to the bottom downward on account of gravitational force and therefore towards the production pipeline and may be simply pumped out there and transported to the earth's surface. The transporting may be achieved either by oil lift pumps or by introduction of an overpressure in the deposit. The introduction of overpressure has the significant disadvantage, however, that earth displacements on the earth's surface (e.g., blow out) may occur in the surrounding area of the deposit, especially when the stratum above the deposit is of small thickness. For this reason, the steam pressure, before introduction into the deposit, may be reduced by a restrictor or a throttle valve to a pressure that is lower than the rock pressure in the region of the deposit. The throttle valve is arranged between the steam generator and the injection pipeline in this case. Since the steam pressure is reduced in the throttle valve, without being utilized, the process is inefficient.

For this reason, in German patent application 10 2012 000092.8, with the title "Device and method for extracting carbonaceous substances from oil sands," it is proposed to arrange at least one steam turbine between the steam generator and the injection pipeline. By arranging the steam turbines between the steam generator and the injection pipeline, the pressure reduction, which is usually carried out via the throttle valve, without being utilized, may be utilized for power recovery. To this end, the steam turbine may be connected to a generator for power generation.

A further common in-situ process is electromagnetic gravity drainage (EMGD). With the EMGD process, the heating of the deposit is carried out using an electric/electromagnetic heating method, in which, for example, an inductive heating is carried out. The EMGD process is disclosed in the German patent application 10 2007 040605.5, with the title "Device for the in-situ transporting of bitumen or heavy oil,". The EMGD process is also associated with large expenditure of energy.

SUMMARY AND DESCRIPTION

The scope of the present invention is defined solely by the appended claims and is not affected to any degree by the statements within this summary.

The present embodiments may obviate one or more of the drawbacks or limitations in the related art. For example, the known in-situ process is developed such that the efficiency of the device is increased. As another example, a corresponding method for extracting carbonaceous substances is provided.

In addition to high energy demand, processing of a bitumen-water emulsion also causes problems. During the processing, it may not be provided that the water is totally separated from the bitumen. Rather, consideration is therefore to be given to the fact that residues of bitumen remain in the water and, as a result, ultimately in the steam. These cause considerable problems when using a steam turbine since contamination may occur inside the steam turbine and as a result, lead to an altered operating behavior of the steam turbine. The carbonaceous substances may attack the material of the steam turbine so that high-quality and therefore more expensive materials are to be used for the steam turbine.

Starting from the previously described problem, a device for extracting carbonaceous substances (e.g., bitumen) from oil sands that avoids the previously described disadvantages and has a high level of efficiency is provided.

A method for extracting carbonaceous substances (e.g., bitumen) from oil sands by such a device is also provided.

The device according to one or more of the present embodiments for extracting carbonaceous substances (e.g., bitumen) from oil sands includes at least two separate steam circuits (e.g., a first steam circuit and a second steam circuit). The first steam circuit includes at least one first steam generator and a steam turbine that is connected to the first steam generator and has an intermediate steam extraction point. The second steam circuit includes at least one second steam generator (e.g., in the form of a first heat exchanger), an injection pipeline, a production pipeline, and a water processing plant. Steam may be introduced into the oil sand via the injection pipeline, the carbonaceous substances may be discharged from the oil sand via the production pipeline, and the bitumen may be separated from the water in the water processing plant. The intermediate steam extraction point of the first steam circuit is in functional communication with the first heat exchanger of the second steam circuit.

As a result of an embodiment of the device with at least two steam circuits, the steam circuit with which the steam turbine is operated may be operated as a closed circuit that does not come into contact with carbonaceous substances. Therefore, no impurities arise in the first steam circuit, and contamination and damage to the steam turbine do not have to be taken into consideration. As a result of this, the operating reliability of the steam turbine is increased and the use of expensive special materials, which are insensitive to carbonaceous substances, may be dispensed with. As a result of this, the costs of the steam turbine may be reduced.

The second steam circuit serves for generating steam that may be directed via the injection pipelines into the deposit of oil sands. The steam heats the deposit and consequently the oil sands. As a result of this, the breaking up of the long-chain hydrocarbons occurs. The viscosity of the bitumen is reduced. As a result of this, the bitumen becomes free-flowing. The free-flowing bitumen sinks towards the bottom in the process due to gravitational force and may then be transported to the surface as a bitumen-water emulsion. For the transporting, simple oil lift pumps, for example, are suitable. The bitumen-water emulsion may then be processed in a corresponding processing plant, where the water of the bitumen-water emulsion may be fed to the second steam circuit via a corresponding return line. Bitumen residues in the steam do not make their way into the steam turbine in this case on account of the separate steam circuit; therefore, the bitumen residues do not lead to malfunctions of the steam turbine. As a result of the design of the device for extracting carbonaceous substances from oil sands with two separate steam circuits according to one or more of the present embodiments, there therefore exists a circuit with "cleaner" steam that serves for operating the steam turbine, and there exists an open circuit with "impure" steam for heating the oil sand deposits.

One embodiment of the device, in which the steam turbine is connected on the output side to a first generator for power generation, is distinguished by the fact that the device includes an electric/electromagnetic heater for heating the oil sands and may be operated by electric power that is generated by the first generator. As a result of the additional electric/electromagnetic heater, a particularly fast and efficient heating of the oil sand deposit results. As a result of this, an especially efficient breaking up of the long-chain hydrocarbons is carried out, and a rapid viscosity reduction is made possible. As a result of this, the deposits may be mined in an optimum manner. Owing to the fact that the first generator is mounted directly on the drive side of the steam turbine, the electric power is used for the electric/electromagnetic heater without large losses. As a result of this, a high level of efficiency of the device according to one or more of the present embodiments results. A further embodiment provides that the device includes at least one heat engine (e.g., a gas turbine) that is connected on the output side to a second generator for power generation, and that the electric power, which is generated by the second generator, may be used for the simultaneous or alternative heating of the oil sands by the electric/electromagnetic heater. By using a heat engine for generating additional electric power, the electric/electromagnetic heater may be of a correspondingly more powerful design and may be adapted to the available oil sand deposit. Using suitable switching, the electric/electromagnetic heater may be operated solely by the heat engine, solely by the steam turbine, or by both the steam turbine and the heat engine or associated generators. Depending on the generated electric power and the required electric power of the electric/electromagnetic heater, the generators may additionally deliver power for auxiliary units or feed power into an electricity network.

A further embodiment provides that the steam generation in the first steam circuit is carried out by a second heat exchanger. The hot exhaust gas of the heat engine is used for steam generation in the first steam circuit. By utilizing the waste heat of the exhaust gas of the heat engine, the efficiency of the device according to one or more of the present embodiments may be increased. The heat release in this case may be carried out in a heat exchanger, where the exhaust gas flows through the heat exchanger in counterflow to the water/steam of the first steam circuit.

The method according to one or more of the present embodiments for extracting carbonaceous substances (e.g., bitumen) from oil sands by a device includes generating steam in a first steam generator of the first steam circuit. The steam is fed to the steam turbine. A first portion of the steam is expanded to a first pressure, and the first condensed portion of the steam is fed to the first steam generator. A second portion of the steam is extracted at the intermediate steam extraction point of the steam turbine and the second portion of the steam is fed back via the first heat exchanger of the second steam circuit to the first steam generator. Steam is generated in the first heat exchanger of the second steam circuit. The steam of the second steam circuit is introduced into the oil sand via the injection pipeline. The oil sand is heated by the steam of the second steam circuit, and the long-chain hydrocarbons of the carbonaceous substances are broken up. The carbonaceous substances are discharged via the production pipeline. The carbonaceous substances are fed to the processing plant, and the water is separated from the bitumen. The separated water is fed to the first heat exchanger of the second steam circuit.

Using the method according to one or more of the present embodiments, the carbonaceous substance (e.g., bitumen) is mined from the oil sand, via a separate steam circuit, from the oil sand occurrence or the oil sand deposit and in the process, does not come into communication with the steam circuit that serves for operating the steam turbine. Resulting from this is an "impure" steam circuit that may contain constituents of bitumen, and a "clean", closed steam circuit for operating the steam turbine. The two steam circuits that are independent of each other provide a high level of operational reliability and reduce the costs for the steam turbine since no contamination may occur, and therefore, the materials for the steam turbine may be of a lower quality than those used previously.

BRIEF DESCRIPTION OF THE DRAWINGS

FIG. 1 shows a schematic and simplified view of one embodiment of a device for extracting carbonaceous substances.

DETAILED DESCRIPTION

FIG. 1 shows an exemplary embodiment of a device for extracting carbonaceous substances (e.g., bitumen) from oil sands. The oil sands are located in deposits 14 in the ground. If the rock layer above the deposit 14 is not excessively large, the mining of the oil sands is carried out by open cast mining. After a specified depth of, for example, more than 60 m, the open cast mining is no longer economical, however, so that use is made of the in-situ process that is described in the description introduction.

The device according to one or more of the present embodiments for such an in-situ process includes at least two separate steam circuits 1, 5 (e.g., a first steam circuit 1 and a second steam circuit 5). The first steam circuit 1 includes, for example, at least one first steam generator 2 and a steam turbine 3 that is connected to the first steam generator 2 and has an intermediate steam extraction point 4. The second steam circuit 5 includes at least one second steam generator (e.g., in the form of a first heat exchanger 7), an injection pipeline 8, a production pipeline 9, and a water processing plant 10. The injection pipeline 8 and the production pipeline 9 may extend horizontally inside the deposit 14 (not shown in FIG. 1). The injection pipeline 8 and the production pipeline 9 extend, for example, in parallel and typically at a distance of about 5 m to 10 m from each other. In the horizontal direction, the pipes extend inside the deposit 14 over a length of between several hundred meters and a few kilometers. Via the injection pipeline 8, steam may be introduced into the deposit 14 and consequently into the oil sand. The superheated steam provides a breaking up of the long-chain hydrocarbons and a reduction of the viscosity of the bitumen. By breaking up the long-chain hydrocarbons of the highly viscous bitumen and by reducing the viscosity, the bitumen becomes free-flowing. The free-flowing bitumen sinks towards the bottom in the process on account of gravitational force and may then be transported to the surface as a bitumen-water emulsion. For the transporting, simple oil lift pumps 15, for example, are suitable.

The bitumen-water emulsion may then be processed in a corresponding processing plant 10 to form crude oil. The water of the bitumen-water emulsion is recovered in the processing plant 10 and fed again to the second steam generator 6 via a corresponding feedback line 16. The intermediate steam extraction point 4 of the first steam circuit 1 is in functional communication with the first heat exchanger 7 of the second steam circuit 5. This provides that the superheated steam is extracted from the intermediate steam extraction point, and thermal energy in the first heat exchanger 7 is released to the water/steam of the second steam circuit 5 and consequently provides evaporation of the water in the second steam circuit 5. During this, there is no direct contact between the water/steam of the first steam circuit 1 and the water/steam of the second steam circuit 5. The first steam circuit 1 is operated as a closed steam circuit. As a result of this, no contamination of the water/steam in the first steam circuit 1 may occur. Contamination of the water/steam of the first steam circuit 1 with bitumen is therefore excluded. As a result of this, the operational reliability of the device according to one or more of the present embodiments noticeably increases compared with the devices that are described in the prior art. The steam turbine and the associated auxiliary units and pipelines may be produced from simpler materials. As a result of this, the costs for the steam turbine may be reduced. The steam turbine 3 is connected on the output side to a first generator G1. The generator G1 generates electric power that serves directly for operating an electric/electromagnetic heater 11. The electric/electromagnetic heater also serves for heating the oil sand deposits. The electric/electromagnetic heater 11 is introduced in the deposit in addition to the injection and production pipelines. As a result of the additional electric/electromagnetic heater 11, a particularly efficient heating of the deposit is achieved. As a result of this, an efficient breaking up of the long-chain hydrocarbons and a substantial lowering of the viscosity of the bitumen are achieved. As a result of this, the deposit may be mined in a very efficient manner.

The device also includes a heat engine in the form of a gas turbine 12 that is connected on the output side to a second generator G2. The generator G2 also generates electric power that may be used for operating the electric/electromagnetic heater 11. Provision may be made for switching that enables the electric/electromagnetic heater 11 to be operated either solely via the steam turbine 3, solely via the gas turbine 12, or via the gas turbine 12 and the steam turbine 3, or corresponding generators, at the same time. Depending on the required electric power, the gas turbine 12 may be correspondingly designed.

The electric power that is generated by the generators G1 and G2 and not required may be additionally used for operating additional and auxiliary units of the plant or be fed into an electricity network.

The steam generation in the first steam circuit is carried out in the exemplary embodiment by a second heat exchanger 13. The second heat exchanger 13 is fed by hot exhaust gas of the heat engine 12, and in this case, the hot exhaust gas passes through the second heat exchanger 13 in counterflow to the water/steam of the first steam circuit 1. The second heat exchanger 13 may be additionally heated by a fired boiler or the like.

The method according to one or more of the present embodiments for extracting carbonaceous substances (e.g., bitumen) from oil sands by the previously described device is explained briefly below. Steam is generated in the first steam generator 2 in the first steam circuit 1 and fed to the steam turbine 3. A first portion of the steam is largely fully expanded in the steam turbine 3 and then condensed in an additional condenser 16 and fed to the first steam generator 2 via additional pumps 17, 18 and a degassing-/deaerating device 19. A second portion of the steam is extracted from the steam turbine 3 at the intermediate steam extraction point 4. The steam that is extracted from the intermediate steam extraction point 4 and has a higher temperature is fed back to the first steam generator 2 of the first steam circuit 1 via a first heat exchanger 7 of the second steam circuit 5. The steam flows, for example, through the first heat exchanger 7 in counterflow to the water/steam of the second steam circuit 5 and in the process releases a portion of the heat to the water/steam of the second steam circuit 5. As a result of this, steam is generated in the first heat exchanger 7 of the second steam circuit 5 and is introduced into the oil sand via the injection pipeline 8. The superheated steam heats the oil sand and provides a breaking up of the long-chain hydrocarbons of the carbonaceous substances and leads to a reduction of the viscosity. As a result of this, sinking of the bitumen-water emulsion occurs on account of gravitational force. The bitumen-water emulsion may be discharged via the production pipeline 9 and fed to a processing plant 10. A simple oil lift pump 15 is used for this purpose. In the processing plant 10, the bitumen is separated from the water. The bitumen may then be processed to form crude oil. The water that is separated from the bitumen is fed again to the first heat exchanger 7 and evaporated. Water that is lost in the process is replaced.

The device according to one or more of the present embodiments is distinguished by two separate steam circuits, where a first steam circuit exists as a closed steam circuit and the steam turbine is operated within the closed steam circuit. The first, closed, steam circuit is not in communication with the carbonaceous substances so that contamination of the first steam circuit, and consequently contamination of the steam turbine, may not occur. As a result of this, the operational reliability of the steam turbine is increased and the use of high-quality materials may be dispensed with. As a result of this, a cost reduction results. The extraction of the carbonaceous substances from the oil sands is carried out in a second, open, steam circuit. In this circuit, it does not matter if residues of bitumen are present in the steam.

The elements and features recited in the appended claims may be combined in different ways to produce new claims that likewise fall within the scope of the present invention. Thus, whereas the dependent claims appended below depend from only a single independent of dependent claim, it is to be understood that these dependent claims may, alternatively, be made to depend in the alternative from any preceding or following claim, whether independent or dependent. Such new combinations are to be understood as forming a part of the present specification.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. A device for extracting carbonaceous substances from oil sands, the device comprising:

at least two separate steam circuits, wherein a first steam circuit of the at least two separate steam circuits comprises at least one first steam generator and a steam turbine that is connected to the at least one first steam generator and has an intermediate steam extraction point, wherein a second steam circuit of the at least two separate steam circuits comprises at least one second steam generator, an injection pipeline, a production pipeline, and a water processing plant, wherein steam is introducible into an oil sand via the injection pipeline, the carbonaceous substances being dischargeable from the oil sand via the production pipeline, and a bitumen being separateable from water in the water processing plant, and wherein the intermediate steam extraction point of the first steam circuit is in functional communication with a first heat exchanger of the second steam circuit.

2. The device of claim 1, wherein the steam turbine is connected on an output side to a first generator for power generation, and wherein the device further comprises an electric/electromagnetic heater for heating the oil sands, the electric/electromagnetic heater being operateable with electric power that is generated by the first generator.

3. The device of claim 2, wherein the device further comprises at least one heat engine that is connected on an output side to a second generator for power generation, and wherein electric power that is generated by the second generator is useable for simultaneous or alternative heating of the oil sands by the electric/electromagnetic heater.

4. The device of claim 3, wherein the steam generation is carried out in the first steam circuit by a second heat exchanger, and wherein superheated exhaust gas of the at least one heat engine is used for steam generation in the first steam circuit.

5. The device of claim 3, wherein the at least one heat engine comprises a gas turbine.

* * * * *